US011464269B2

(12) United States Patent
Reinhall et al.

(10) Patent No.: US 11,464,269 B2
(45) **Date of Patent: *Oct. 11, 2022**

(54) LAYERED MATERIALS AND STRUCTURES FOR ENHANCED IMPACT ABSORPTION

(71) Applicants: VICIS, Inc., Seattle, WA (US); University of Washington, Seattle, WA (US)

(72) Inventors: Per Reinhall, Seattle, WA (US); Paul C. Leonard, Woodinville, WA (US); Travis Edward Glover, Seattle, WA (US); Andre Hunter Paggao Stone, Seattle, WA (US); Anton Perry Alferness, Seattle, WA (US); Kurt V. Fischer, Edmonds, WA (US); Gary S. Kaplan, Mountain View, CA (US); John T. Dardis, II, Seattle, WA (US); Samuel R. Browd, Seattle, WA (US)

(73) Assignees: VICIS IP, LLC, New York, NY (US); University of Washington, Seattle, WA (US)

( * ) Notice: Subject to any disclaimer, the term of this patent is extended or adjusted under 35 U.S.C. 154(b) by 324 days.

This patent is subject to a terminal disclaimer.

(21) Appl. No.: 16/570,670

(22) Filed: Sep. 13, 2019

(65) Prior Publication Data

US 2020/0000169 A1 Jan. 2, 2020

Related U.S. Application Data

(63) Continuation of application No. 15/399,659, filed on Jan. 5, 2017, now Pat. No. 10,433,609.

(Continued)

(51) Int. Cl.

| | |
|---|---|
| ***A42B 3/06*** | (2006.01) |
| ***A42B 3/12*** | (2006.01) |
| *A41D 13/015* | (2006.01) |

(52) U.S. Cl.

CPC ..... *A42B 3/063* (2013.01); *A42B 3/064* (2013.01); *A42B 3/121* (2013.01); *A42B 3/125* (2013.01); *A41D 13/015* (2013.01)

(58) Field of Classification Search

CPC ..... A42B 3/063; A42B 3/064; A42B 3/121; A42B 3/125; A42B 3/127; A41D 13/015

See application file for complete search history.

(56) References Cited

U.S. PATENT DOCUMENTS 7,673,351 B2 * 3/2010 Copeland ..... A42B 3/124 2/425
8,069,498 B2 * 12/2011 Maddux ..... A41D 13/0156 2/414

(Continued)

FOREIGN PATENT DOCUMENTS

WO WO 2015/069800 5/2015

OTHER PUBLICATIONS

PCT International Search Report and Written Opinion, PCT Application No. PCT/US2017/012394, dated Mar. 17, 2017, 15 pages.

*Primary Examiner* — Tajash D Patel
(74) *Attorney, Agent, or Firm* — Fish & Richardson P.C.

(57) ABSTRACT

A garment worn by a wearer has an exterior shell and an interior shell with various impact absorbing material between the exterior shell and the interior shell. The impact absorbing material includes multiple structures, such as rods or filaments, capable of deforming when force is applied then returning to its state prior to application of the force. In various embodiments, a rate sensitive material (RSM) is positioned in one or more locations relative to the exterior shell and the interior shell of the garment to further attenuate impacts to the garment. The RSM changes its resistance to force based on a rate at which the material is loaded.

16 Claims, 10 Drawing Sheets

Related U.S. Application Data

(60) Provisional application No. 62/276,652, filed on Jan. 8, 2016.

(56) References Cited

U.S. PATENT DOCUMENTS

| | | | | |
|---|---|---|---|---|
| 8,510,863 | B2 * | 8/2013 | Ferguson | A42B 3/124 2/69 |
| 8,566,968 | B2 * | 10/2013 | Marzec | A42B 3/12 2/411 |
| 8,679,047 | B2 | 3/2014 | Holt et al. | |
| 9,743,702 | B2 * | 8/2017 | Warmouth | A42B 3/32 |
| 10,433,609 | B2 * | 10/2019 | Reinhall | A42B 3/063 |
| 2002/0120978 | A1 | 9/2002 | Moore, III | |
| 2005/0166302 | A1 | 8/2005 | Dennis | |
| 2006/0260026 | A1 | 11/2006 | Doria et al. | |
| 2008/0155735 | A1 | 7/2008 | Ferrara | |
| 2010/0258988 | A1 * | 10/2010 | Darnell | A42B 3/124 267/141 |
| 2011/0283433 | A1 | 11/2011 | Holt et al. | |
| 2013/0305435 | A1 | 11/2013 | Surabhi | |
| 2014/0013491 | A1 * | 1/2014 | Hoshizaki | A42B 3/064 2/411 |
| 2014/0189945 | A1 | 7/2014 | Golnaraghi | |
| 2015/0033453 | A1 | 2/2015 | Pannikottu et al. | |
| 2015/0257471 | A1 | 9/2015 | Warmouth et al. | |
| 2016/0278470 | A1 | 9/2016 | Posner et al. | |
| 2017/0273387 | A1 | 9/2017 | Sicking et al. | |
| 2017/0280810 | A1 | 10/2017 | Surabhi | |
| 2017/0303623 | A1 | 10/2017 | Sicking et al. | |
| 2018/0110281 | A1 | 4/2018 | Morgan et al. | |
| 2020/0022444 | A1 * | 1/2020 | Stone | A42B 3/062 |

* cited by examiner

LAYERED MATERIALS AND STRUCTURES FOR ENHANCED IMPACT ABSORPTION

CROSS-REFERENCE TO RELATED APPLICATIONS

This application is a continuation of U.S. patent application Ser. No. 15/399,659 filed Jan. 5, 2017, entitled "Layered Materials and Structures for Enhanced Impact Absorption," which claims the benefit of U.S. Provisional Patent Application No. 62/276,652, filed on Jan. 8, 2016, which are hereby incorporated by reference herein in their entireties.

BACKGROUND

A helmet protects a skull of the wearer from collisions with the ground, equipment, and other players. Present helmets were designed with the primary goal of preventing traumatic skull fractures and other blunt trauma. In general, a helmet includes a hard, rounded shell and cushioning inside the shell. When another object collides with the helmet, the rounded shape deflects at least some of the force tangentially while the hard shell distributes the normal force over a wider area of the head. Such helmets have been successful at preventing skull fractures but leave the wearer vulnerable to concussions.

A concussion occurs when the skull changes velocity rapidly relative to the enclosed brain and cerebrospinal fluid. The resulting collision between the brain and the skull results in a brain injury with neurological symptoms such as memory loss. Although the cerebrospinal fluid cushions the brain from small forces, the fluid does not absorb all the energy from collisions that arise in sports such as football, hockey, skiing, and biking. Helmets include cushioning to dissipate some of the energy absorbed by the hard shell, but the cushioning is insufficient to prevent concussions from violent collisions or from the cumulative effects of many lower velocity collisions.

Rate sensitive materials (RSM) and/or rate sensitive elements are materials or structures that change their resistance to force the faster the materials are loaded. RSMs are commonly used in protective gear, such as helmets. Combining RSMs and/or rate-sensitive structures with impact absorbing structures or other materials or structures may further improve the function of protective gear.

SUMMARY

In various embodiments, a helmet includes two generally concentric shells with impact absorbing structures between the shells. The inner shell may be somewhat rigid to protect against skull fracture and the outer shell may also somewhat rigid to spread impact forces over a wider area of the impact absorbing structures positioned inside the outer shell, or the outer shell may be more flexible such that impact forces locally deform the outer shell to transmit forces to a smaller, more localized section of the impact absorbing structures positioned inside the outer shell. The impact absorbing structures are secured between the generally concentric shells and have sufficient strength to resist forces from mild collisions. However, the impact absorbing structures undergo deformation (e.g., buckling, bending, crushing, crumpling) when subjected to forces from a sufficiently strong impact force. As a result of the deformation, the impact absorbing structures reduce energy transmitted from the outer shell to the inner shell, thereby reducing forces on the wearer's skull and brain. The impact absorbing structures may also allow the outer shell to move independently of the inner shell in a variety of planes or directions. Thus, impact absorbing structures reduce the incidence and severity of concussions as a result of sports and other activities. When the outer and inner shell move independently from one another, rotational acceleration, which contributes to concussions, may also be reduced.

In various embodiments, a rate sensitive material (RSM) is positioned in one or more locations relative to the inner shell and the outer shell of the helmet to further attenuate impacts to the helmet. A RSM is a material that changes its resistance to force based on a rate at which the material is loaded. Hence, a RSM provides greater resistance to an impact force that is more quickly applied to the RSM. In various embodiments, the resistance to impact of a RSM is inversely proportional to a rate at which an impact force is applied to the RSM. In various embodiments, a (RSM) is between the inner shell and the outer shell, while external to the impact absorbing structure. With a RSM external to the impact absorbing structures and internal to the outer shell, the RSM does not provide resistance to a force applied from a low velocity impact, allowing greater deformation of impact absorbing structures proximate to the low velocity impact. However, when a force is applied from a high velocity impact, the RSM provides resistance to the impact by stiffening, which increases a number of impact absorbing structures that are engaged from the high velocity impact.

In other embodiments, a RSM forms the inner shell and the outer shell of the helmet. Alternatively, the inner shell and the outer shell of the helmet each include a layer of RSM coupled to a layer of a material that is more rigid than the RSM (e.g., plastic). In some embodiments, the RSM is also included in the impact absorbing structures coupled to the inner shell and to the outer shell. For example, the impact absorbing structures comprise a plastic (or other material more rigid that the RSM) shell filled with the RSM. The plastic increases a yield strength of the impact absorbing structures and increases the energy dispersed by deformation of the impact absorbing structures, while the included RSM in the impact absorbing structures further dissipates energy from collisions and increases a yield strength of the impact absorbing structures relative to a hollow cylindrical rigid plastic shell. In another embodiment, the impact absorbing structures are constituted from a RSM. An impact absorbing structure most efficiently absorbs energy from an impact by compressing or collapsing as much as possible without fully collapsing; if an impact absorbing structure fully collapses, a greater amount of the energy from the impact is not absorbed by the impact absorbing structure. Without including a RSM in the impact absorbing structure, a single type of impact force (e.g., high velocity impact, low velocity impact) to the impact absorbing structure may collapse the impact management structure an amount that most efficiently absorbs energy from the impact. However, including a RSM within the impact absorbing structure allows the impact absorbing member to collapse amounts that most efficiently absorbs energy from different types of impact forces (low and high velocity) to the impact absorbing structure. Additionally, various materials and structures, each with its own specific function, may be positioned within a helmet (or other protective garment) relative to the inner shell, the outer shell, and the impact absorbing structures to enhance the helmet. Other possible materials that could be layered are impact reducing foams, open call foams, gels, and shape memory alloys.

DETAILED DESCRIPTION

Modular Helmet

Figure 1:
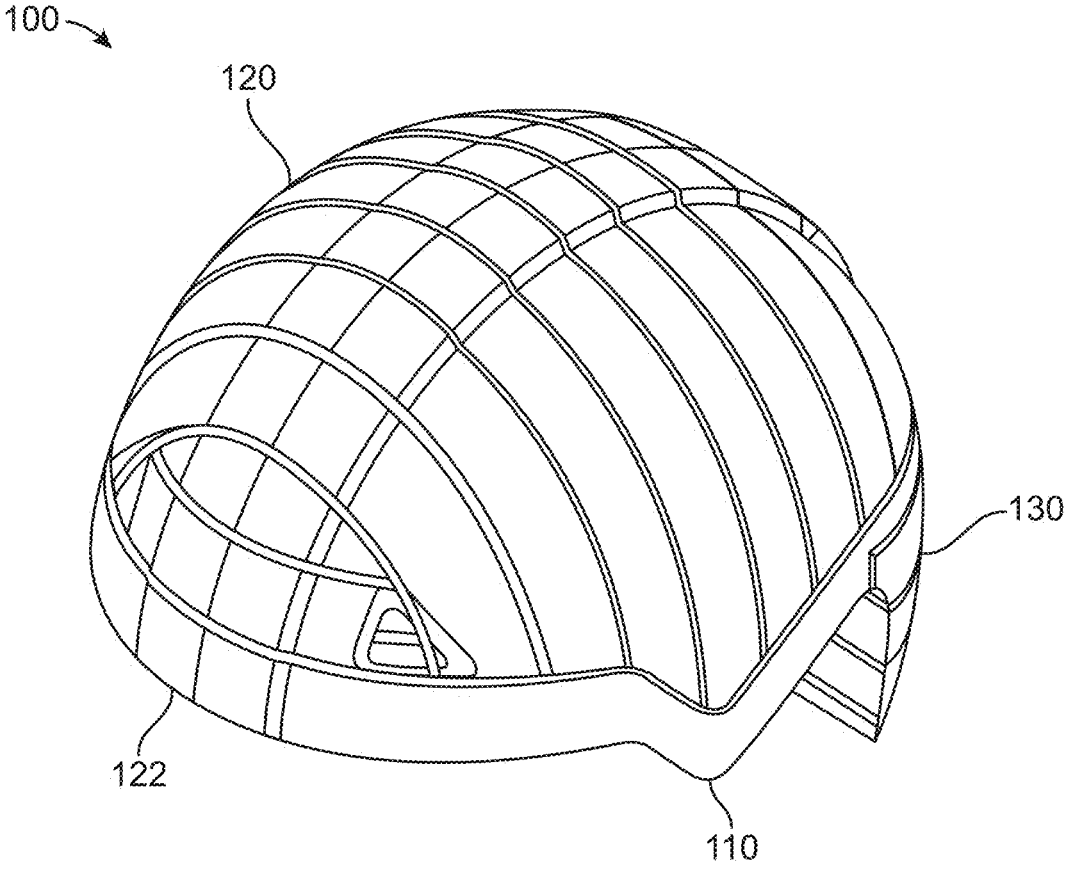
FIG. 1 is a perspective view of an assembly of impact absorbing structures formed from modular rows, in accordance with an embodiment.

FIG. 1 is a perspective view of an assembly 100 of impact absorbing structures formed from modular rows 110, 120, and 130, in accordance with an embodiment. In general, a modular row includes an inner surface, an outer surface, and impact absorbing structures between the inner surface and the outer surface. The modular row may further include a protective layer (e.g., foam) less rigid than the impact absorbing structures that encloses a remaining volume between the inner surface and outer surface after formation of the impact absorbing members. When a helmet including the assembly 100 is worn, the inner surface is closer to the user's skull than the outer surface. Optionally, the modular row includes end surfaces connecting the short edges of the inner surface to the short edges of the outer surface. The inner surface, outer surface, and end surfaces form a slice with two parallel flat sides and an arc or bow shape on two other opposing sides. The end surfaces may be parallel to each other or angled relative to each other. The modular rows include one or more base modular rows 110, crown modular rows 120, and rear modular rows 130. The assembly 100 may include further shells, such as an innermost shell, an outermost shell, or both, that secure the modular rows relative to each other and capture the structure between the innermost and outermost shells when assembled for durability and impact resistance.

The base modular row 110 encircles the wearer's skull at approximately the same vertical level as the user's brow. The crown modular rows 120 are stacked horizontally on top of the base modular row 110 so that the long edges of the inner and outer surfaces form parallel vertical planes. The end surfaces of the crown modular rows 120 rest on a top plane of the base modular row. The outer surfaces of the crown modular rows 120 converge with the outer surface of the base modular row 110 to form a rounded outer shell. Likewise, the inner surfaces of the crown modular rows 120 converge with the inner surface of the base modular row 110 to form a rounded inner shell. Thus, the crown modular rows 120 and base modular row 110 form concentric inner and outer shells protecting the wearer's upper head. The outer surface of a crown modular row 120 may form a ridge 122 raised relative to the rest of the outer surface. The ridge 122 may improve resistance to impact forces or facilitate a connection between two halves (e.g., left and right halves) of an outermost layer of a helmet including the assembly 100.

The rear modular rows 130 are stacked vertically under a rear portion of the base modular row 110 so that the long edges of the inner and outer surfaces form parallel horizontal planes. The inner surface of the topmost rear modular row 130 forms a seam with the inner surface of the base modular row 110, and the outer surface of the topmost rear modular row 130 forms a seam with the outer surface of the base modular row 110. Thus, the rear modular rows 130 and the rear portion of the base modular row 110 form concentric inner and outer shells protecting the wearer's rear lower head and upper neck.

In various embodiments, a modular row includes a rate sensitive material (RSM) positioned externally to the impact absorbing structures but internally to the outer surface; hence, the RSM is outside of the impact absorbing structures, but between the inner surface and the outer surface in various embodiments. A RSM is a material that changes its resistance to force based on a rate at which the material is loaded. Hence, a RSM provides greater resistance to an impact force that is more quickly applied to the RSM. In various embodiments, the resistance to impact of a RSM is inversely proportional to a rate at which an impact force is applied to the RSM. With a RSM outside of the impact absorbing structures and inside the outer surface, the RSM does not provide resistance to a force applied from a low velocity impact, allowing greater deformation of impact absorbing structures proximate to the low velocity impact. However, when a force is applied from a high velocity impact, the RSM provides resistance to the impact by stiffening, which increases a number of impact absorbing structures that are engaged from the high velocity impact.

Alternatively, a RSM is positioned between the inner surface of the modular row or the inner surface of the modular row comprises a RSM. In such embodiments, the RSM is flexible under normal circumstances, providing a comfortable fit for a wearer of a helmet or other structure including the modular row. However, when a force is applied to the modular row from a high velocity impact, the RSM stiffens to provide increased protection for the wearer from the high velocity impact.

Figure 2:
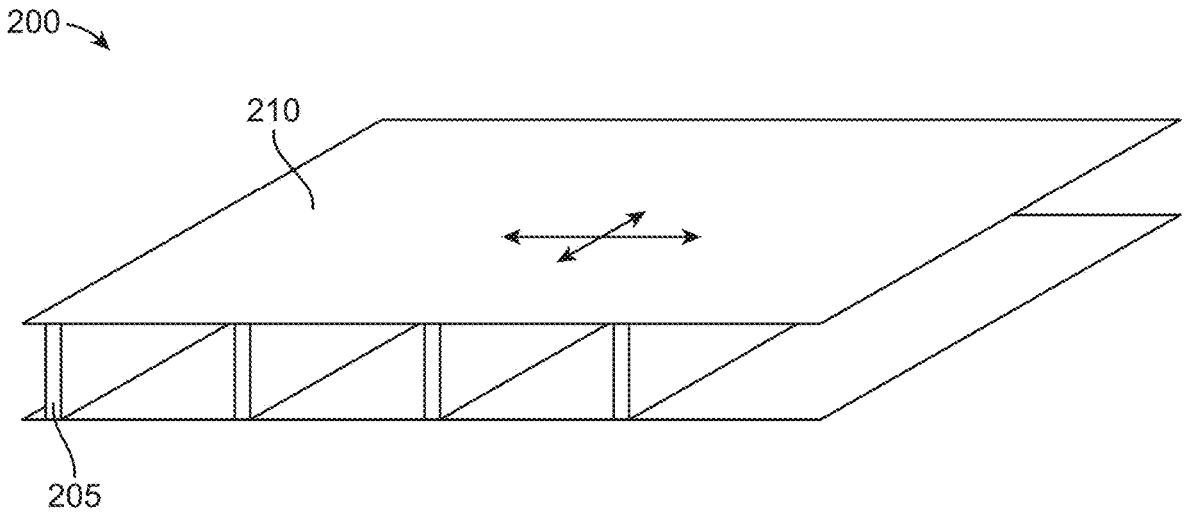
FIG. 2 is a perspective view of an impact absorbing structure comprising one or more walls, in accordance with an embodiment.

FIG. 2 shows one embodiment of an impact absorbing structure 200 comprising one or more walls 205. Having the impact absorbing structure 200 formed from multiple walls 205 allows the impact absorbing structure 200 to provide directionally biased compression. In the embodiment shown by FIG. 2, the impact absorbing structure 200 comprises one or more sheets of walled or cellular structures. In some embodiments, an outer surface 210 of the impact absorbing structure is transversely slit to allow softer compression.

Similarly, the walls 205 may be partially or fully transversely slit to allow for softer compression in some embodiments. This allows the impact absorbing structure 200 to flex both perpendicularly to and parallel to the walls 205, which reduces rotational impacts as well as linear impacts. In some embodiments, a softer layer is positioned outside of the outer surface of a modular row including the impact absorbing structure to provide additional protection from repetitive low velocity impacts.

Figure 3:
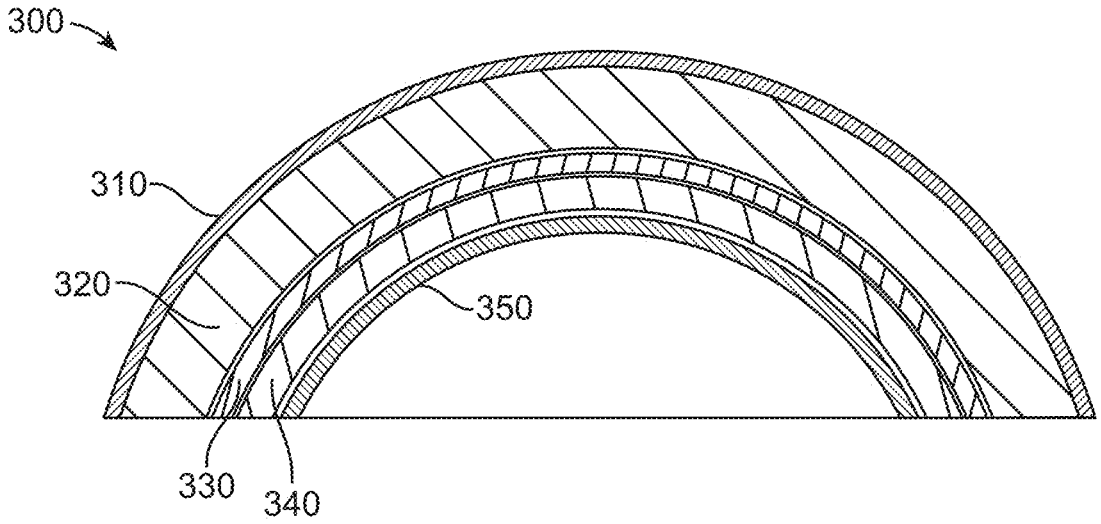
FIG. 3 is a cross-sectional view of an embodiment of a helmet including a rate sensitive material and one or more impact absorbing structures, in accordance with an embodiment.

FIG. 3 is a cross-sectional view of an embodiment of a helmet 300 including a RSM and one or more impact absorbing structures. In the example shown by FIG. 3, the helmet includes an external shell 310, a foam 320 (e.g., an open cell foam or other impact absorbing foam), a rigid middle shell 330, impact absorbing structures 340, and a rigid inner shell 350. In various embodiments, the external shell 310 is flexible. The inner shell 350 and the middle shell 330 may be used together in some embodiments. In other embodiments, the inner shell 350 and the middle shell 330 are used independently of each other. Additionally, one or more of the middle shell 330 and the inner shell 350 may include a RSM in some embodiments. Alternatively, neither the middle shell 330 nor the inner shell 350 include a RSM. In some embodiments, the helmet 300 includes alternating layers of foam 320 and impact absorbing structures 340. For example, the helmet includes a layer of foam 320, with a layer of impact absorbing structures 340 on a side of the layer of foam 320, and another layer of foam 320 on another side of the layer of impact absorbing structures 340. As another example, the helmet includes a layer of impact absorbing structures 340, with a layer of foam 320 on a side of the layer of impact absorbing structures 340, and another layer of impact absorbing structures 340 on another side of the layer of foam 320. In other embodiments, layers of foam 320 are adjacent to each other or layers of impact absorbing structures 340 are adjacent to each other. Additionally, the foam 320 or the impact absorbing structures may include a RSM in various embodiments. In various embodiments, the foam 320 is configured to attenuate lower velocity impacts, while the rigid outer shell 330 is configured to distribute impact force from high velocity impacts. Additionally, the impact absorbing structures 340 may include smaller and more tightly spaced filaments that are configured to attenuate impact forces from high velocity impacts, while the rigid inner shell 350 is positioned nearest a wearer's head and provide protection against skull fractures. Accordingly, the helmet 300 shown in FIG. 3 is configured to provide optimal protection for a wearer from both high velocity and low velocity impacts. In some embodiments, shock absorbers including air or fluid within filaments of the impact absorbing structures are combined with orifice vents to slow acceleration.

Alternatively, the external shell 310 comprises a RSM, causing a rate of impact to the helmet 300 to modify an amount of the external shell 310 that deforms when an impact is applied to the helmet 300. For example, changes in the rate of impact to the helmet 300 cause the external shell 310 to change from deforming locally (e.g., within a particular radius of a location of the impact to the helmet 300) to deforming regionally (e.g., within an increased radius of the location of the impact to the helmet 300) to deforming globally, As an example, an impact to the helmet 300 having less than a threshold rate deforms the external shell 310 within a particular radius of a location of the impact, using a limited amount of the impact absorbing structures 340 to attenuate a force of the impact; however, an impact to the helmet 300 having greater than the threshold rate deforms the external shell 310 within an increased radius of the location of the impact, increasing an amount of the impact absorbing structures 340 used to attenuate the force of the impact.

Figure 4:
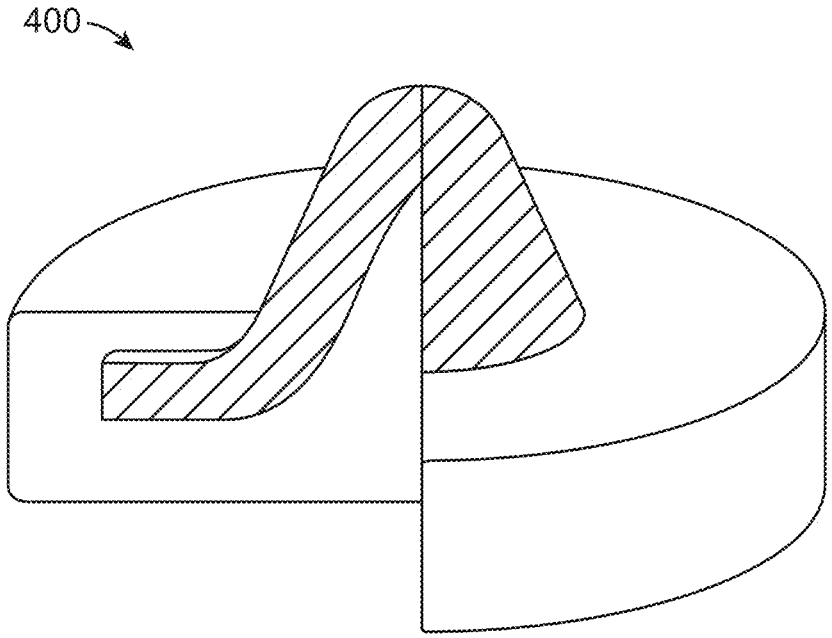
FIG. 4 is an example of a domed structure mounted to a rate sensitive material panel positioned between an inner shell of a helmet and an outer shell of the helmet, in accordance with an embodiment.

In various embodiments, different structures are mounted inside a helmet between an inner shell and an outer shell to enhance impact protection. FIGS. 4-7 show examples of various impact absorbing structures positioned between the inner shell and the outer shell in different embodiments. FIG. 4 shows an embodiment of a an impact absorbing structure comprising a rate sensitive element. The rate sensitive element includes a domed structure 400 mounted to a RSM panel positioned between a rigid inner shell of a helmet and a flexible outer shell of the helmet. The domed structure 400 is configured to compress before the RSM begins to compress, allowing the helmet to accommodate different deflection profiles. In some embodiments, the domed structure 400 is filled with a fluid, such as air, and includes an orifice having one or more dimensions that are configured to release the fluid from the domed structure 400 at a specific rate to dampen deflection of the domed structure 400. Dome shaped structures gain greater stability from the three-dimensional flow of forces, and from compressive hoop forces, which prevent the dome from falling inward under dead load.

Figure 5:
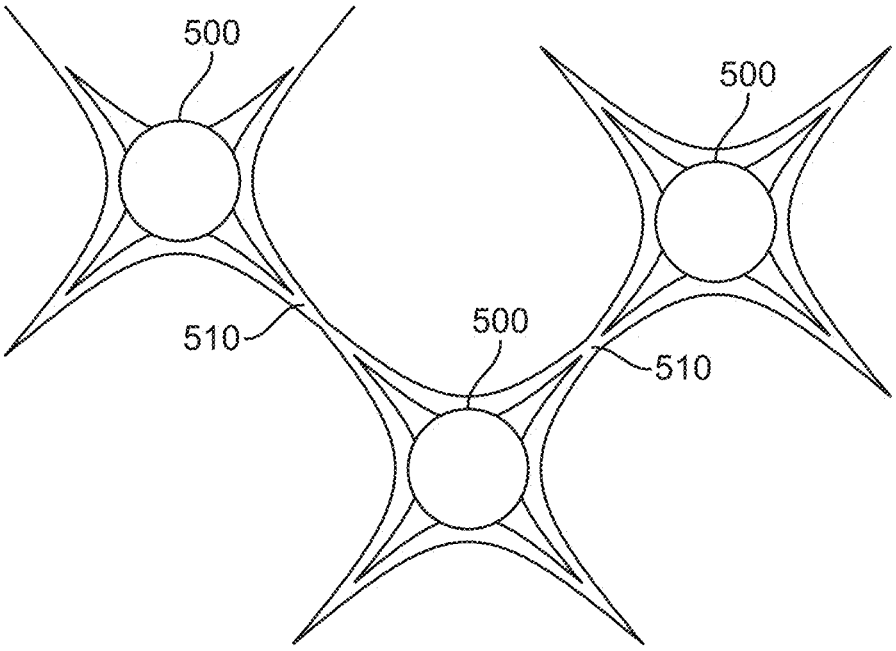
FIG. 5 is an example of a fluid-filled or gel-filled module configured to be positioned between an inner shell of a helmet and an outer shell of the helmet, in accordance with an embodiment.

FIG. 5 shows one embodiment of impact absorbing structures comprising fluid-filled or gel-filled modules 500 configured to be positioned between a rigid inner shell of a helmet and a flexible outer shell of the helmet. The fluid-filled or gel-filled modules 500 comprises a rate sensitive element or a rate sensitive material (RSM). The fluid-filled or gel-filled modules 500 are coupled to a RSM panel positioned between the rigid inner shell and the flexible outer shell of the helmet. In various embodiments, a plurality of fluid-filled or gel-filled modules 500 are interconnected, allowing fluid or gel to pass from a module 500 to another module 500 via connections 510 between the modules 500. When a module 500 is compressed, gel or fluid within the module 500 is directed to one or more adjacent modules 500 via connections 510 between the module 500 and the adjacent modules 500, cushioning impact causing compression of the module 500. The rate sensitive element includes non-Newtonian or shear sensitive liquids or gels that change viscosity when under stress or pressure.

Figure 6:
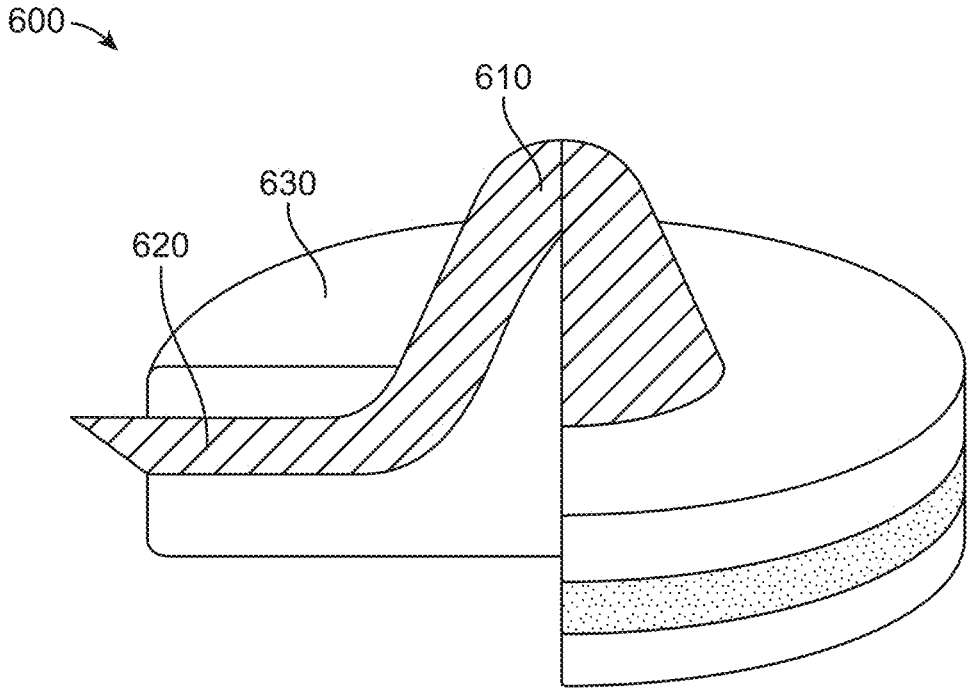
FIG. 6 is an example of a friction based shock absorber configured to be positioned between an inner shell of a helmet and an outer shell of the helmet, in accordance with an embodiment.

FIG. 6 shows one embodiment of a friction based shock absorber 600 configured to be positioned between a rigid inner shell of a helmet and a flexible outer shell of the helmet. The example shock absorber 600 shown in FIG. 6 includes a dome 610 and a lateral rim 620 at a base of the dome 610. As the dome 610 compresses, the lateral rim 620 slides inside an outer disk structure 630 encircling the lateral rim 620. Friction between the lateral rim 620 and the outer disk structure 630 may be modified to control a rate of compression of the dome 610. In some embodiments, a damping mechanism is also included in the shock absorber 600.

Figure 7:
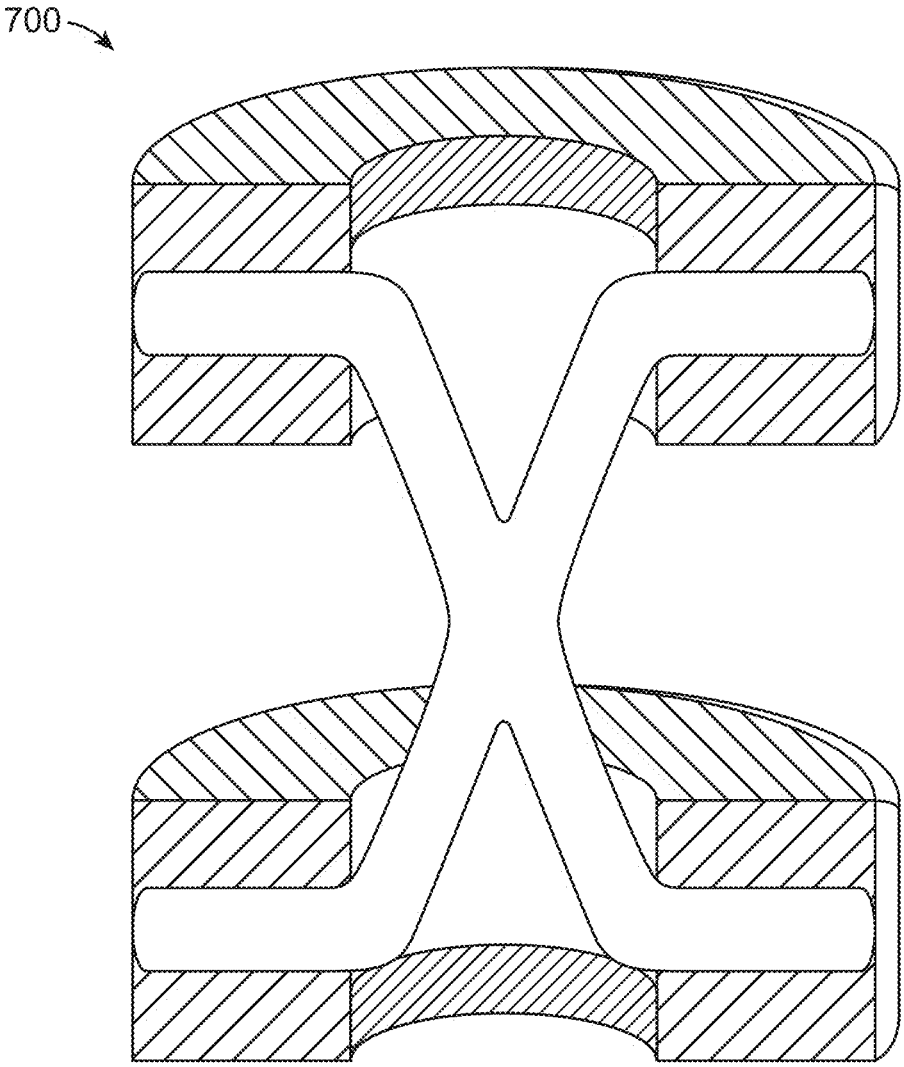
FIG. 7 is an example a cross-shaped module configured to be positioned between a inner shell of a helmet and an outer shell of the helmet, in accordance with an embodiment.

FIG. 7 shows one embodiment of an impact absorbing structure comprising a cross-shaped module 700 configured to be positioned between a rigid inner shell of a helmet and a flexible outer shell of the helmet. An end of the cross-shaped module 700 is coupled to the rigid inner shell, while an opposing end of the cross-shaped module 700 is coupled to the flexible outer shell of the helmet. In some embodiments, the cross-shaped module 700 is rubber. Translational movement of the cross-shaped module 700 along a plane parallel to the rigid inner shell dampens force from rotational impacts to the helmet, while compression of the cross-shaped module 700 along a plane perpendicular to the rigid inner shell dampens force from linear impacts to the helmet. Additionally, friction between different portions of the cross-shaped module 700 may be modified based on the material, or materials, used to form the cross-shaped module 700 may be modified to control a rate at which the cross-shaped module 700 compresses when an impact force is applied to the helmet.

Figure 8:
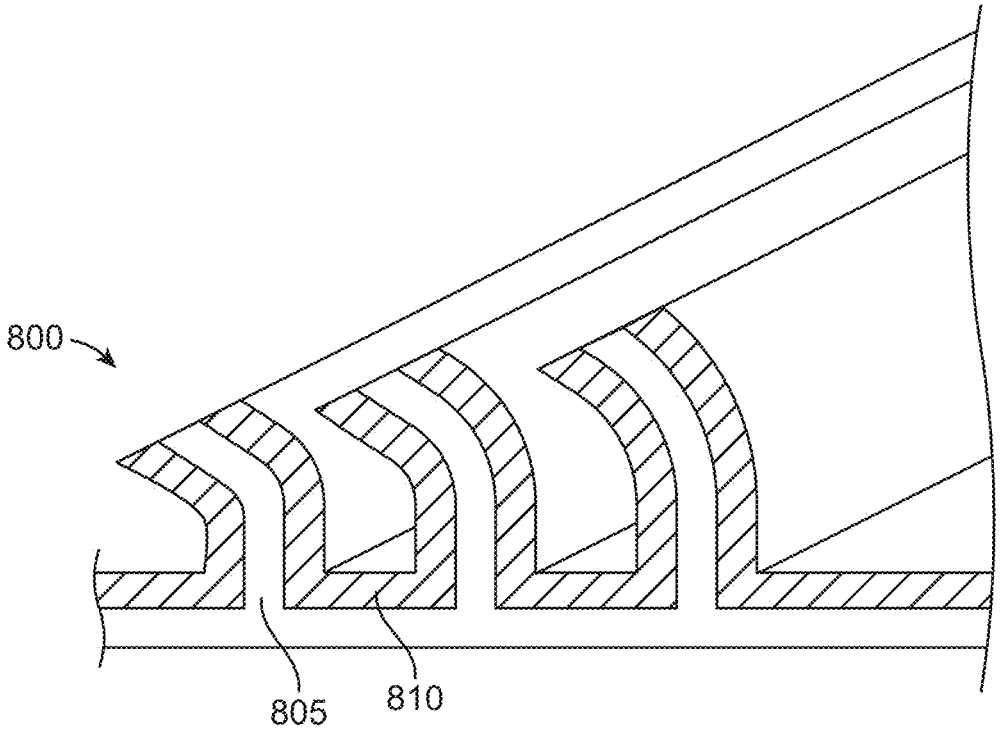
FIG. 8 is a side view of an impact absorbing structure comprising layered plastic blades and a rate sensitive material, in accordance with an embodiment.

FIG. 8 shows a side view of an impact absorbing structure 800 comprising layered plastic blades 805 and a RSM 810. In the example shown by FIG. 8, the impact absorbing structure 800 comprises a plastic blade 805 with a layer of RSM 810 contacting a surface of the plastic blade 805 and another layer of RSM 810 contacting another surface of the plastic blade 805 that is parallel to the surface of the plastic blade 805. In various embodiments, the plastic blade 805 is positioned between an inner surface and an outer surface of a modular row. For example, an end of the plastic blade 805 contacts the inner surface, while an opposing end of the plastic blade 805 contacts the outer surface. When a low velocity impact applies a force to a modular row including the impact absorbing structure 800, the plastic blade 805 deforms to attenuate the force. However, when a high velocity impact applies a force to the modular row including the impact absorbing structure 800, the RSM 810 stiffens to attenuate the force.

Figure 9:
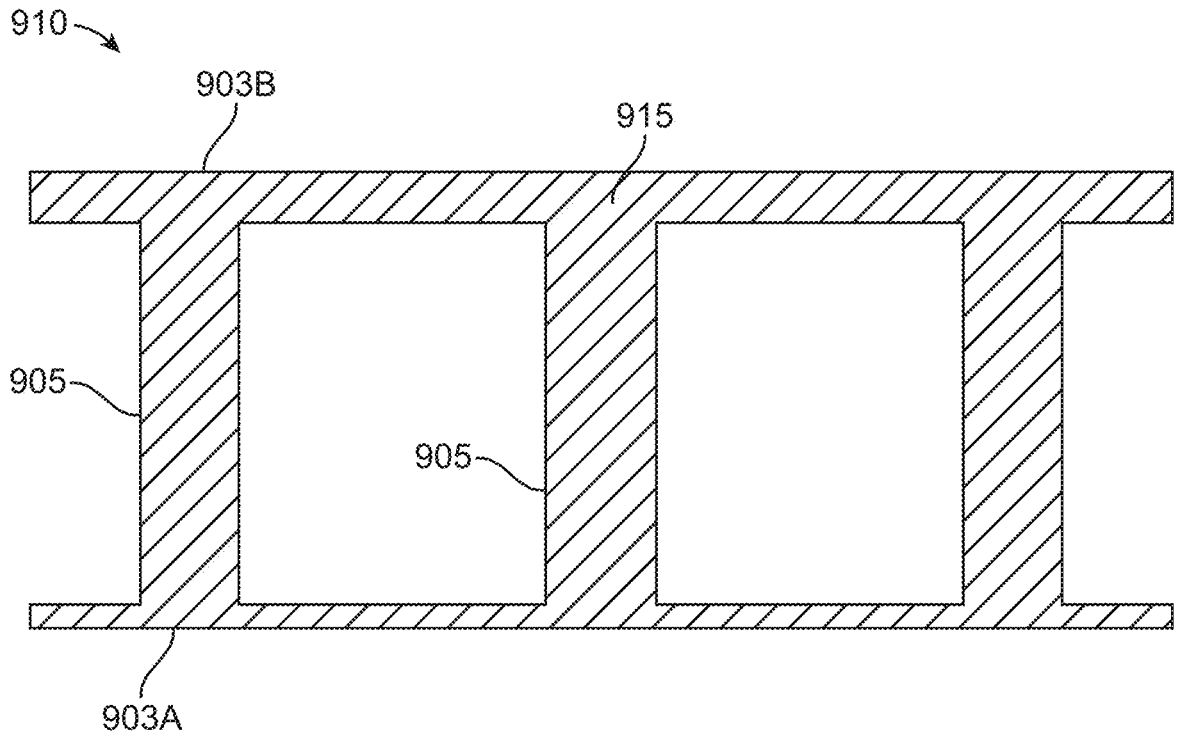
FIG. 9 is a cross-sectional view of an impact absorbing member combined with a RSM, in accordance with an embodiment.

FIG. 9 is a cross-sectional view of an impact absorbing member 905 combined with a RSM 915. In FIG. 9, a partially formed modular row 910 includes a concentric surface 903A, a concentric surface 903B, and impact absorbing members 905 formed through a standard injection molding, fusible core injection molding, or last wax casting process. Cores corresponding to an interior of the impact absorbing members 905 are formed (e.g., by molding or casting) from a fusible material (e.g., wax, chocolate, salt, soap, glycerine, tin-bismuth alloy, polyvinyl acrylate (PVA) support material). The cores are then held inside an injection mold to form hollow portions inside the impact absorbing members 905. The injection molding forms the concentric surface 903A and the hollow columns of the impact absorbing members 905 around the cores. For example, the injection molding is performed by injecting a plastic (e.g., urethane) between upper and lower pieces of the injection mold. The cores are then removed from the impact absorbing members 905 using a process such as heating the fusible core above the melting point of the fusible core (e.g., wax) and below the melting point of the rigid plastic. As another example, the fusible core is dissolved in a solvent that does not harm the structural integrity of the rigid plastic. As a result, the impact absorbing members 905 become hollow tubes secured on a planar or rounded concentric surface 903A.

A RSM 915 is combined with the partially formed modular row 910. In some embodiments, the RSM 915 forms the concentric surface 903A and the other concentric surface 903B. In other embodiments, each concentric surface 903A, 903B includes a layer of plastic coupled to a layer of RSM 915. Alternatively, the RSM 915 forms the concentric surface 903B and augments plastic to form concentric surface 903A. For example, the RSM 915 is injected between two pieces of an injection mold. Thus, the injection molding process forms impact absorbing members 905 including a plastic shell filled with the RSM 915. The plastic increases a yield strength of the impact absorbing members 905 and increases the energy dispersed by deformation of the impact absorbing members 905. The RSM 915 further dissipates energy from collisions and increases a yield strength of the impact absorbing members 905 relative to a hollow cylindrical rigid plastic shell. Alternatively, the injection molding process forms impact absorbing members that include a RSM shell filled with plastic, such as urethane. Additional examples of impact absorbing members 905 are further described in international application number PCT/US2014/064173, filed on Nov. 5, 2014, which is hereby incorporated by reference in its entirety.

Figure 10A:
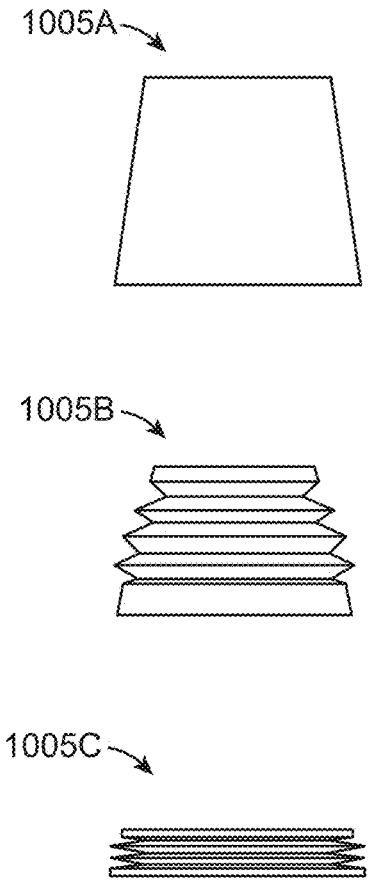
FIGS. 10A-10C are side views of responses of different impact absorbing structures to impact forces, in accordance with an embodiment.
Figure 10B:
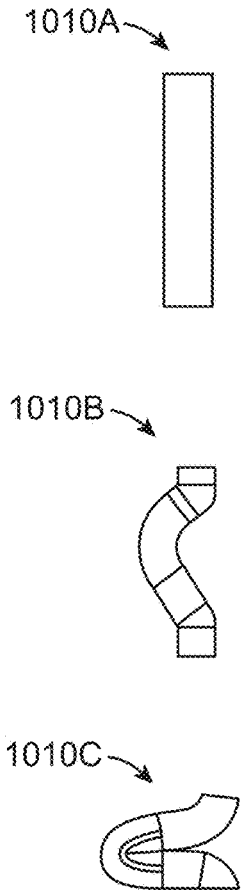
Figure 10C:
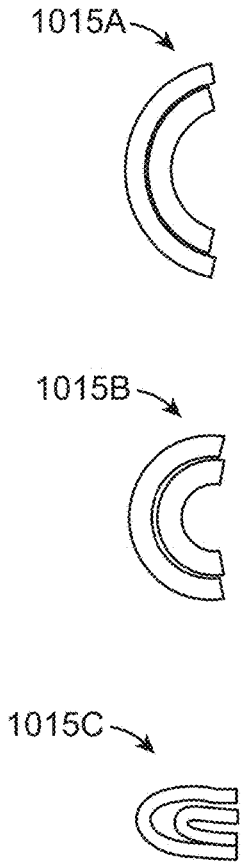

FIGS. 10A-10C are side views of responses of different embodiments of impact absorbing structures comprising a rate sensitive element or rate sensitive material (RSM). FIG. 10A shows an impact absorbing structure comprising a body with a rate sensitive element or an RSM in an uncompressed state 1005A. The body with a rate sensitive element comprises a tapered or frustum shaped body that allows omnidirectional deformation in different stages, heights or levels along the length of the body. The compression response impact absorbing structure (e.g., a collapsible structure) is also shown in a partially compressed state 1005B. In the partially compressed state 1005B, the compression response impact absorbing structure absorbs energy from an impact to a garment (e.g., a helmet) including the compression response impact absorbing structure without using all of the available deflection area of the compression response impact absorbing structure, which causes excess energy from the impact to be transmitted to a wearer of the garment (e.g., a helmet). FIG. 10A shows the compression response impact absorbing structure in an optimally compressed state 1005C, in which the impact absorbing structure most efficiently absorbs the applied impact force, minimizing an amount of the impact force transmitted to a wearer of a garment (e.g., a helmet) including the compression response impact absorbing structure.

FIG. 10B shows an omnidirectional deformation impact absorbing structure comprising a body with a rate sensitive element or an RSM in an uncompressed state 1010A and in a partially compressed state 1010B. The body with a rate sensitive element comprising an elongated, columnar body. In the partially compressed state 1010B, the omnidirectional deformation impact absorbing structure absorbs energy from an impact to a garment (e.g., a helmet) including the omnidirectional deformation impact absorbing structure without using all of the available deflection area of the omnidirectional deformation impact absorbing structure, which causes excess energy from the impact to be transmitted to a wearer of the garment (e.g., a helmet). FIG. 10B shows the omnidirectional deformation impact absorbing structure in an optimally compressed state 1010C, in which the impact absorbing structure most efficiently absorbs the applied impact force, minimizing an amount of the impact force transmitted to a wearer of a garment (e.g., a helmet) including the compression response impact absorbing structure.

FIG. 10C shows a directionally controlled impact absorbing structure comprising a body with a rate sensitive element or an RSM in an uncompressed state 1015A and in a partially compressed state 1015B. The body with a rate sensitive element comprises a first curved beam and a second curved beam. The first curved beam having a first radius and a first length, and second curved beam having a second radius and a second length. The first and second radius is different, and/or the first and second length is different. The second curved beam is adjacent laterally to first curved beam. The first and second curved beam having an arc or arched shape. The impact absorbing structure is also depicted in the partially compressed state 1015B, the directionally controlled impact absorbing structure absorbs energy from an impact to a garment (e.g., a helmet) including the directionally controlled impact absorbing structure without using all of the available deflection area of the directionally controlled impact absorbing structure, which causes excess energy from the impact to be transmitted to a wearer of the garment (e.g., a helmet). FIG. 10C shows the directionally controlled impact absorbing structure in an optimally compressed state 1015C, in which the impact absorbing structure most efficiently absorbs the applied impact force, minimizing an amount of the impact force transmitted to a wearer of a garment (e.g., a helmet) including the compression response impact absorbing structure. Such curved beams are advantageous due their capacity of transferring loads through combined action of bending and stretching, thus producing an optimal rate sensitive response, as well as control direction of the deformation and the axial deformation displacement during an impact.

If an impact absorbing structure does not include an RSM, the impact absorbing structure is compressed to the optimally compressed state 1005C, 1010C, 1015C when a particular impact force is applied to the impact absorbing structure, while being compressed to the partially compressed state 1005B, 1010B, 1015C when other types of impact forces are applied to the impact absorbing structure. Hence, without an RSM, an impact absorbing structure is limited to efficiently absorbing a particular impact force, while allowing a greater amount of other types of impact forces to be transmitted to a wearer of a garment including the impact absorbing structure. However, including a RSM in the impact absorbing structure allows the impact absorbing structure to be compressed to the optimally compressed state 1005C, 1010C, 1015C when various impact forces are applied to the impact absorbing structure, allowing the impact absorbing structure to more efficiently absorb different impact forces, optimally-reducing the amounts of different impact forces transmitted to a wearer of a garment including the impact absorbing structure. Hence, including a RSM in an impact absorbing structure allows the impact absorbing structure to better absorb forces caused by different types of impacts (e.g., high velocity impacts, low velocity impacts) to the impact absorbing structure.

Although described throughout with respect to a helmet, the impact absorbing structures described herein may be applied with other garments such as padding, braces, and protectors for various joints and bones.

Additional Configuration Considerations

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosed embodiments are intended to be illustrative, but not limiting, of the scope of the disclosure.

What is claimed is:

1. A helmet comprising:

an outer shell; and a plurality of impact absorbing structures positioned inside the outer shell, the plurality of impact absorbing structures having a body including a rate-sensitive element, the rate-sensitive element configured to provide a rate sensitive response that resists an impact force at an inversely related rate to which the impact force is applied to the helmet.

2. The helmet of claim 1, wherein the outer shell is flexible.

3. The helmet of claim 1, wherein the helmet further comprises an inner shell.

4. The helmet of claim 1, wherein the outer shell comprises a rate-sensitive material (RSM).

5. The helmet of claim 1, wherein the helmet further comprises a rate-sensitive material layer, the rate sensitive material layer positioned adjacent to at least one end of the plurality of impact absorbing structures.

6. The helmet of claim 5, wherein the rate sensitive material layer comprises foam.

7. The helmet of claim 1, wherein the body including a rate sensitive element comprises a fluid-filled or gel-filled module.

8. The helmet of claim 1, wherein the body including rate sensitive element comprises a first curved beam and a second curved beam.

9. The helmet of claim 1, wherein the body including a rate sensitive element comprises a frustum shaped body.

10. A helmet comprising:

an outer shell;

an inner shell, a plurality of impact absorbing structures having an end inside the outer shell and proximate to the outer shell at one end and an opposite end outside the inner shell and proximate to the inner shell, the plurality of impact absorbing structures having a rate sensitive means.

11. The helmet of claim 9, wherein the impact absorbing structure includes the rate sensitive material.

12. The helmet of claim 9, wherein the outer shell is flexible.

13. The helmet of claim 9, wherein the inner shell is rigid.

14. The helmet of claim 9, wherein the outer shell comprises a rate sensitive material.

15. The helmet of claim 9, wherein the helmet further comprises a rate sensitive material layer, the rate sensitive material layer positioned adjacent to at least one end of the plurality of impact absorbing structures.

16. The helmet of claim 15, wherein the rate sensitive material layer comprises a foam.

* * * * *